United States Patent [19]

Hoover et al.

[11] Patent Number: 5,070,759

[45] Date of Patent: Dec. 10, 1991

[54] STRING VIBRATION SUSTAINING DEVICE

[76] Inventors: Alan A. Hoover, 4220 E. 11th St., Indianapolis, Ind. 46201; Gary T. Osborne, 6052 N. Guilford Ave., Indianapolis, Ind. 46220

[21] Appl. No.: 366,181

[22] Filed: Jun. 14, 1989

Related U.S. Application Data

[63] Continuation-in-part of Ser. No. 350,338, May 12, 1989, Pat. No. 4,941,388.

[51] Int. Cl.[5] ..... G10H 3/18; G10H 3/24

[52] U.S. Cl. ..... 84/726; 84/DIG. 10

[58] Field of Search ..... 84/725–729, 84/738, DIG. 10

[56] References Cited

U.S. PATENT DOCUMENTS

| | | | |
|---|---|---|---|
| 472,019 | 3/1892 | Ohmart | 84/441 X |
| 1,002,036 | 8/1911 | Clement | 84/19 |
| 1,893,895 | 1/1933 | Hammond, Jr. | 84/723 |
| 2,001,723 | 5/1935 | Hammond, Jr. | 84/723 |
| 2,600,870 | 6/1952 | Hathaway et al. | 84/DIG. 26 |
| 3,185,755 | 5/1965 | Williams et al. | 84/738 |
| 3,612,741 | 10/1971 | Marshall | 84/DIG. 10 X |
| 3,742,113 | 6/1973 | Cohen | 84/726 |
| 3,813,473 | 5/1974 | Terymenko | 84/742 X |
| 4,075,921 | 2/1978 | Heet | 84/738 |
| 4,164,163 | 8/1979 | Rhodes | 84/728 |
| 4,236,433 | 12/1980 | Holland | 84/726 |
| 4,484,508 | 7/1984 | Nourney | 84/734 |
| 4,852,444 | 8/1989 | Hoover et al. | 84/726 |
| 4,907,483 | 3/1990 | Rose et al. | 84/726 |

FOREIGN PATENT DOCUMENTS

| | | |
|---|---|---|
| 461969 | 12/1949 | Canada . |
| 673375 | 1/1930 | France . |
| 961543 | 5/1950 | France . |
| 8523729 | 9/1985 | United Kingdom . |

OTHER PUBLICATIONS

Lawrence, "Kramer Floyd Rose Sustainer Solid Body Guitar", *Guitar World,* Jul. 1969.

Osborne, Description of Infinite Guitar Sustain Device, 1987.

Osborne, Description of a 1971 Les Paul Recording Guitar.

"The Infinite Guitar", *Making Music,* (Apr. 1987).

"Floyd Rose Sustainer" advertisement, *Guitar Player,* (Jan. 1989).

*Primary Examiner*—W. B. Perkey

*Attorney, Agent, or Firm*—Ice Miller Donadio & Ryan

[57] ABSTRACT

A sustaining device is provided for prolonging the vibration of a string of a stringed musical instrument having a first magnetic pickup means responsive to the vibration of the string. The sustaining device includes a magnetic string driver capable of inducing a vibration in the string. A first amplifier amplifies the output of the pickup to a level that provides sufficient energy to the driver to prolong the vibration of the string. A switch is coupled to the driver for selecting the mode of operation of the driver between the pickup mode of operation wherein the driver functions as a second magnetic pickup, and a driver mode of operation wherein the driver functions as a magnetic string driver. An output changing device is provided that is responsive to the switch for changing the output of at least one of the first pickup and a driver in response to a change in the mode of operation of the driver.

16 Claims, 8 Drawing Sheets

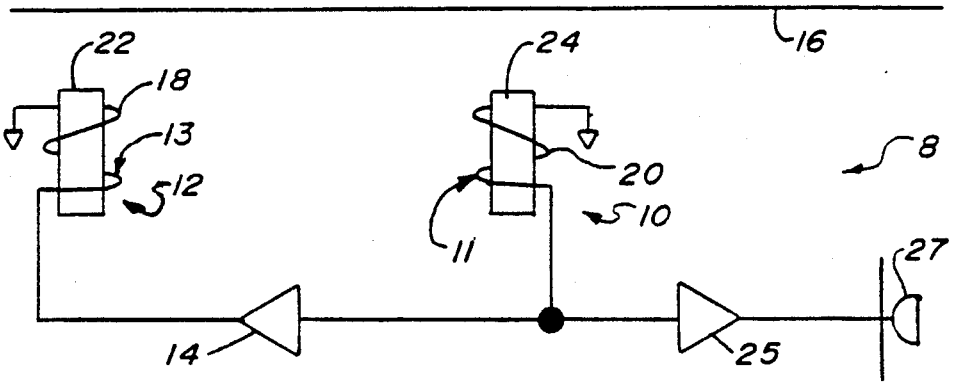
FIG. 1 : PRIOR ART
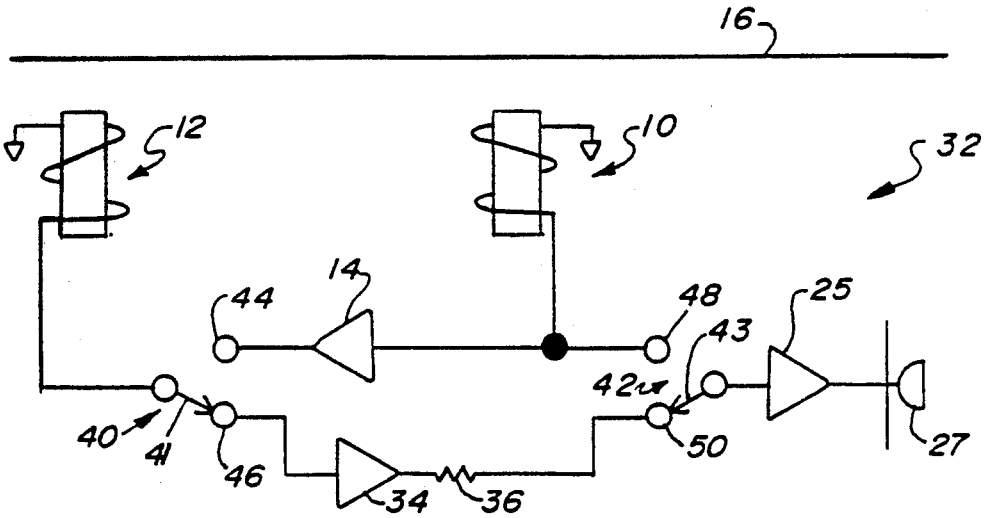
FIG. 2
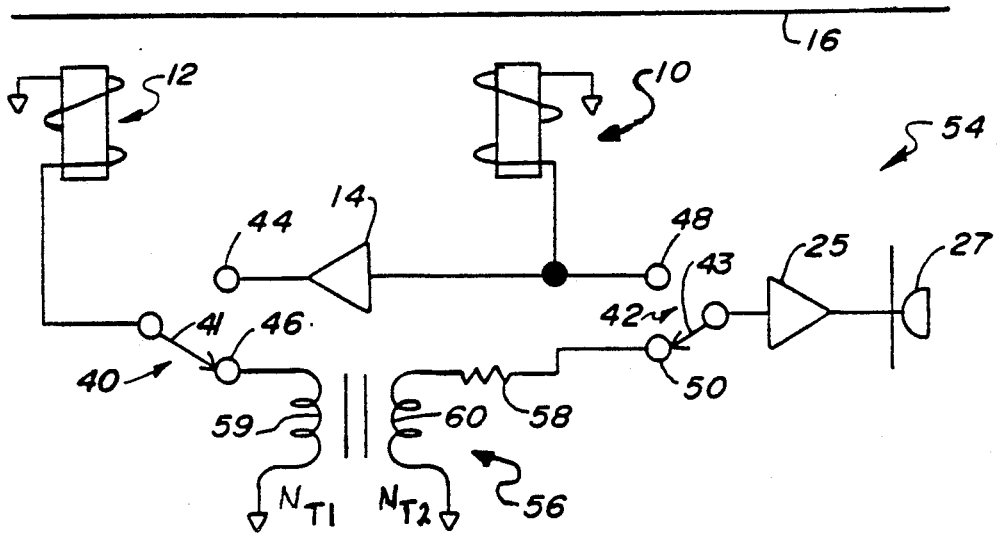
FIG. 3

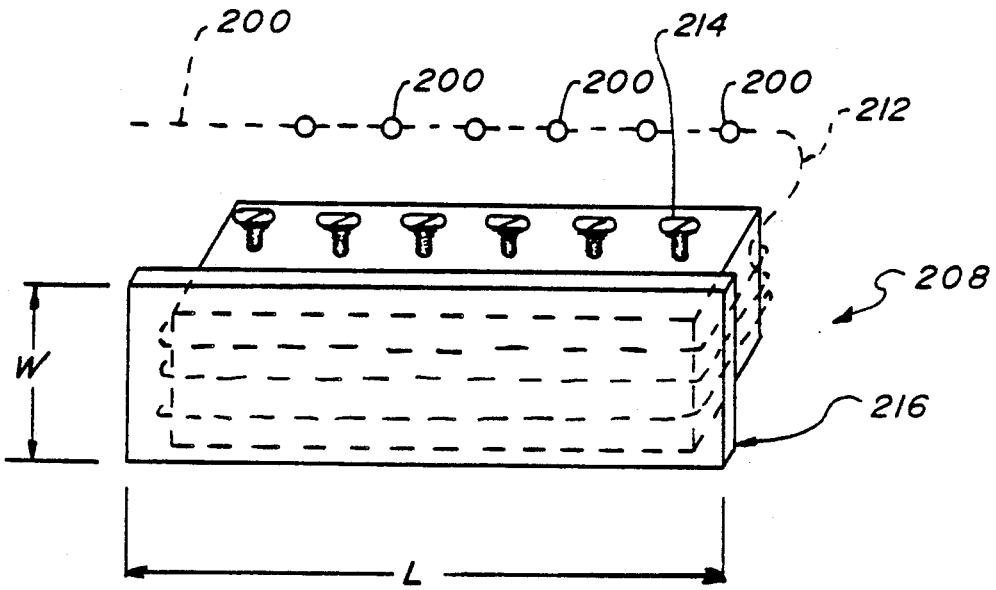
FIG. 20
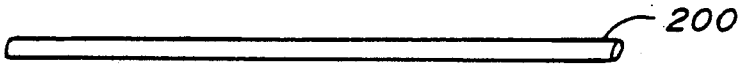
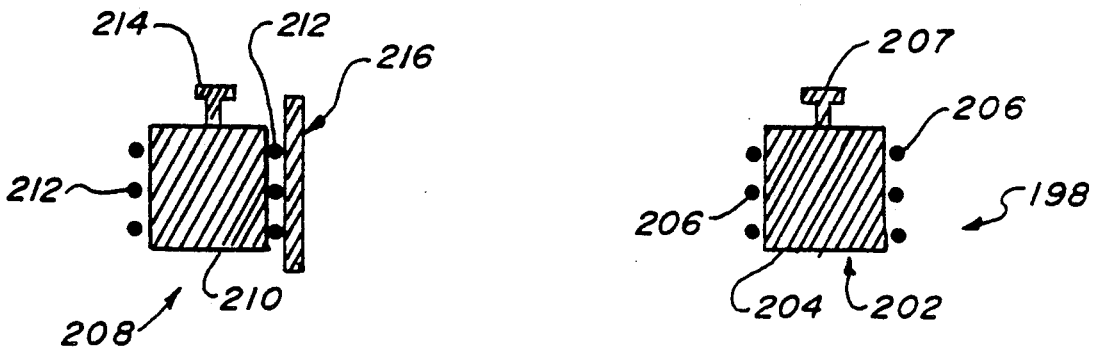
FIG. 19

STRING VIBRATION SUSTAINING DEVICE

BACKGROUND OF THE INVENTION

This application is a continuation-in-part of the Hoover and Osborne U.S. patent application Ser. No. 07/350,338, entitled STRING VIBRATION SUSTAINING DEVICE, filed on May 12, 1989 which has matured into U.S. Pat. No. 4,941,338.

The present invention relates to an electronic device for use in connection with a musical instrument, and more particularly to an electronic device for sustaining the vibration of a string of a stringed musical instrument.

It has long been known that an amplifier can be coupled to a stringed musical instrument to amplify the sound produced by the vibration of the strings of the instrument. Probably the most popular example of such an electrically amplified stringed musical instrument is an electric guitar. An electric guitar typically includes a plurality of strings that extend between the headstock of the guitar and the body of the guitar. A fretted neck is interposed between the headstock and body of the guitar.

In an electric guitar, one or more magnetic pickups are placed on the body of the guitar in magnetic proximity to the strings of the guitar. The magnetic pickups are responsive to the change in magnetic flux caused by the vibration of the strings. This magnetic energy picked up by the pickup is then transmitted to an external amplifier and speaker.

It has long been known that a pickup and external amplifier arrangement on an electric guitar can not only adjust the volume of the sound produced by the guitar, but can also be used by the musician to alter the nature of the sound produced by the guitar. One means for altering this sound is to introduce vibrational feedback into the system to prolong the vibration of the strings of the guitar.

An early method for producing such sustained vibration was for the musician to move the musical instrument in close proximity to the speaker of the amplifier through which the guitar was being amplified. In such a situation, the acoustic energy caused by the sound waves emanating from the speaker would establish a sympathetic vibration of the strings. The vibration of the strings induced by the speaker would then be translated into magnetic flux energy picked up by the pickup means. This magnetic flux energy would then be transmitted through the external amplifier, and would be transformed into sound energy through the speaker of the amplifier. Typically, this situation would result in a "feedback" loop that sustained the vibration of the strings of a musical instrument, and hence the duration of the sound produced by the plucking of the string.

One difficulty, however, with this method of introducing feedback is that it is often difficult to control the amount and type of feedback produced. Hence, it is difficult to control the sound produced through the use of this feedback system. Several devices have been invented to overcome the problems discussed with the above method of sustaining string vibration.

A typical prior art sustain device 8 is shown in FIG. 1 as including a magnetic pickup 10, a magnetic driver 12, and an amplifier 14 interposed between the pickup 10 and driver 12. The pickup is typically comprised of one or more pickup coils, such as pickup coil 11. The driver 12 is typically comprised of one or more of the driver coils, such as driver coil 13.

The sustain system 8 may be used to sustain the vibration of a single string, such as string 16, or a plurality of strings, such as the 4, 6, or 12 strings typically found on an electric guitar. The sustain system is usually disposed on a counter-sunk portion of the upper surface of the body of the electric guitar, so that the pickup 10 and driver 12 are in magnetic proximity to the string 16 of the instrument.

The pickup 10 and driver 12 are constructed generally similarly. Both the pickup 10 and driver 12 are constructed of a number of turns of a conductor means, such as a wire 18, 20 which is wound around a magnetic core 22, 24, respectively. The cores 22, 24 are generally either a permanent magnet, or a ferrous material in contact with a permanent magnet, to provide a permanent magnetic flux through the center of the respective pickup coil 11 and driver coil 13.

The output signal from the pickup 10 is fed to an external amplifier 25. The amplifier 25 amplifies the signal, and feeds the signal to a transducer such as loudspeaker 27. Loudspeaker 27 converts the signal into sound energy which can be heard by the user.

For purposes of this discussion relating to the manner in which such a sustain system works, the pickup coil 11 and driver coil 13 are modeled as ideal inductors, $L_P$ and $L_D$, respectively, having $N_P$ and $N_D$, respectively, turns of wire. The amplifier 14 is modeled as having infinite input impedance, zero output impedance, and a voltage gain of A. The string 16 is assumed to be under tension, free to vibrate, and secured at both ends.

A number of sustain systems exist currently. Among those sustain systems known to Applicants are the SUSTAINIAC Model B sustain system, manufactured by Maniac Music, Inc., of Indianapolis, Ind. This SUSTAINIAC sustain system is described in the Applicant's U.S. patent application Ser. No. 06/937,871, which was filed on Dec. 4, 1986.

Another example of a sustain system is the commercially available E-BOW sustain system manufactured by Gregory A. Heat of Los Angeles, Calif., and described in U.S. Pat. No. 4,075,921; and the sustain system described in Holland U.S. Pat. No. 4,236,433.

Notwithstanding the existence of the above mentioned sustain systems and others, room for improvement exists in the manufacture and design of sustain systems. This room for improvement exists to overcome various problems and difficulties associated with sustain systems.

One difficulty associated with a sustain system is the difficulty of using the driver as a pickup during such times as the driver is not being used as a driver. As the driver is not normally used as a pickup to produce an output in response to string vibration, the driver is generally constructed to have fewer turns of wire ($N_D$) around its core than the pickup ($N_P$). The fewer number of turns of wire around the driver (relative to the pickup) lowers the voltage drive requirement, and therefore the cost and complexity of the amplifier, that provides the drive current to the driver. However, the fewer turns of wire of the driver produce a lower output voltage in response to string vibration when the driver is being used as a pickup. Due to this lower output voltage, the signal produced by the driver, when the driver is being used as a pickup, does not match well with the signal produced by the pickup.

As will be appreciated, it is desirable to use the driver as a secondary pickup to avoid the need for an additional secondary pickup in addition to the primary pickup. For example, many guitars currently use multiple pickups. This use of multiple pickups limits the space available in which to place a driver. Further, the addition of a driver can detract from the cosmetic appearance of the guitar. Thus, it is desirable to provide a driver which can serve "double duty" as both a driver and a pickup to overcome these problems of spatial constraints and adverse cosmetic impact.

Another problem caused by the inability of current drivers to function as pickups relates to the permanent magnetic field created by the driver. Even when the driver is turned "off" and not being used to sustain string vibration, a magnetic field from the driver can still be "sensed" by the strings and causes a vibration damping effect on the strings. This vibration damping effect of the driver can reduce the natural vibration of the string. If the driver can serve as both a pickup and a driver, a guitar can be manufactured having one less pickup, thus reducing the vibration-depleting magnetic field produced by the pickups and driver.

As will also be appreciated, the ability of a driver to serve both as a pickup and a driver can reduce the cost of manufacturing a guitar, as the ability of the driver to do "double duty" eliminates the need for an additional pickup.

Another problem with known sustain devices relates to the interference caused by load generating devices. Load generating devices include such things as volume controls, tone controls, and transmission cables.

These load generating devices can affect the output signal produced by the pickup. This impact on the output signal affects not only the signal transmitted to an external amplifier and speaker, but can also affect the output signal from the pickup that is transmitted to the driver. Thus, the load generating device can impair the performance of the sustain device.

Another problem associated with known sustain systems relates to the efficiency of the driver. Because of the inductive reactance of a driver, it has been found by the Applicants that the driver may be inefficient at transmitting magnetic energy of certain frequencies to a string. This lack of efficiency appears most pronounced at relatively higher frequencies. The result of this inefficiency is that it tends to narrow the effective band width of string harmonics capable of being induced and sustained by the driver.

An additional side effect of the use of an inefficient driver is the relatively large power consumption of an inefficient driver. This large power consumption is especially undesirable in battery powered sustain systems. By making the driver more efficient, power consumption can be decreased while the level of sustain is maintained.

A further problem associated with some known sustain systems relates to the adverse impact on a driver caused by misalignment of strings during manufacturing of the instrument and string bending techniques performed by the musician. Typically, prior art drivers have consisted of a permanent magnet core having a set of magnetic pole pieces (e.g. 6 for a 6 string guitar). The permanent magnet core is disposed in a coiling of wire. The pole pieces were generally constructed of a ferrous material, and placed in contact with the permanent magnet core to give the pole pieces a permanent magnetic flux. An example of such a pole piece is seen on the well known Humbucking pickup disclosed in Cohen U.S. Pat. No. 3,742,113. Alternately, pole pieces in pickups have been constructed of permanent magnets. Such an arrangement is shown in single coil pickups produced by the Fender Guitar Company of 1130 Columbia Street, Brea, Calif. 92621.

The individual pole pieces of prior art pickups are arranged under each string, so that each string has its own individual pickup coil. In some cases, the poles are adjustable in a vertical plane to enable the user to adjust the pole pieces to a position relatively closer to, or relatively farther away from, the string. This adjustment allows the relative volume of each string to be adjusted independently.

One difficulty with such individual pole pieces is that string bending or misalignment of the strings relative to the pole piece adversely affects the pickup's output in response to the string vibrations. In either case, the string moves away from the pole piece, thus reducing the output of the pickup.

To overcome these problems, it has been found that a pickup having a single pole piece oriented generally perpendicular to the strings allows for a constant output, regardless of string bending or misalignment. This style of pickup is shown in the KPU-13 style pickups produced by Kamen Music Corporation of Bloomfield, Conn. Additionally, a sustainer produced by Kramer Music Products, 685 Neptune Boulevard, Neptune, N.J. 07753 exists that includes a dual coil driver wherein one of the driver coils has a single pole piece, and the other driver coil has individual pole pieces. To date, however, no known drivers have been produced that use a curved driver pole piece to maintain a constant distance from the strings.

As can be appreciated from the above recitation of problems, room for improvement exists in sustain systems. It is, therefore, one object of the present invention to provide a sustain device that improves over prior sustain devices by solving one or more of the problems discussed above.

SUMMARY OF THE INVENTION

In accordance with the present invention, a sustaining device is provided for prolonging the vibration of a string of a stringed musical instrument having a first magnetic pickup means responsive to the vibration of the string. The sustaining device comprises a magnetic string driver means capable of inducing a vibration in the string. A first amplifier means amplifies the output of the pickup means to a level that provides sufficient energy to the driver means to prolong the vibration of the string. A switch means is coupled to the driver means for selecting the mode of operation of the driver means between a pickup mode of operation wherein the driver functions as a second magnetic pickup means, and a driver mode of operation wherein the driver means functions as a magnetic string driver means. An output changing means is provided that is responsive to the switch means for changing the output of at least one of the first pickup means and driver means in response to a change in the mode of operation of the driver means.

One feature of this aspect of the present invention is that an output changing means is provided that is responsive to the switch means. The output changing means has the advantage of matching the output of the driver to the pickup means when the driver means is in the pickup mode of operation.

Also in accordance with the present invention, a sustaining device is provided that comprises a magnetic string driver means capable of inducing a vibration in the string, and a first amplifier means for amplifying the output of the pickup means to a level that provides sufficient energy to the driver means to prolong the vibration of the string. A buffer amplifier means is coupled between the first pickup means and the load generating means for isolating the first pickup means from changes in the load generated by the load generating means. Additionally, the buffer amplifier provides a generally constant pickup output signal to the first amplifier means over a range of electrical loads generated by the load generating means.

One feature of this aspect of the present invention is the use of the buffer amplifier means to isolate the pickup. This feature has the advantage of allowing the driver to be unaffected by the presence of a load generating means such as a transmission cable, or a change in the load generated by a load generating means, such as the change in load that occurs when a load generating means, such as a volume control or tone control, is adjusted.

In accordance with another aspect of the present invention, a sustaining device is provided that includes a first amplifier means, a magnetic string driver means, and a resistor means coupled to the driver means. A capacitor means is coupled to the driver means. The capacitor means has a capacitance selected to provide a capacitive reactance for resonating with the inductive reactance of the driver means at a resonant frequency generally equal to a harmonic frequency of the string.

One feature of this aspect of the present invention is that the driver means, resistor means, and capacitor means comprise a resonant circuit. The resonant circuit so formed has the advantage of increasing the efficiency of the driver means, especially at high frequencies. This increased efficiency increases the effective band width of string harmonics that can be induced in the string by the driver means.

In accordance with yet another aspect of the present invention, a sustaining device is provided that includes a first amplifier means, and a magnetic string driver capable of inducing the vibration in the string. The magnetic string driver means comprises at least one driver coil that includes a single magnetic core disposed generally perpendicular to the string, and an electrical conductor wrapped around the magnetic core in a coiled arrangement.

One feature of this aspect of the present invention is that a magnetic string driver is provided that includes a magnetic core disposed perpendicular to the string. This feature has the advantage of providing a driver coil that is not effected by misalignment of the string, or bending of the string, that occurs during the playing of the instrument.

These and other features and advantages of the present invention will become apparent to those skilled in the art upon consideration of the following detailed descriptions of the preferred embodiments exemplifying the best mode of carrying out the invention as perceived presently.

BRIEF DESCRIPTION OF THE DRAWINGS

FIG. 1 is a schematic view of a prior art sustain circuit;

FIG. 2 is a schematic view of a sustain circuit embodying the first aspect of the present invention;

FIG. 3 is a schematic view of an alternate embodiment sustain circuit of the first aspect of the present invention;

FIG. 19 is a schematic side sectional view of a pickup, driver, and unbalancing means used in conjunction with a sustain circuit of the present invention; and FIG. 20 is a schematic, perspective view of a driver and unbalancing means used in conjunction with a sustain circuit of the present invention.

DETAILED DESCRIPTION OF PREFERRED EMBODIMENTS

Figure 2A:
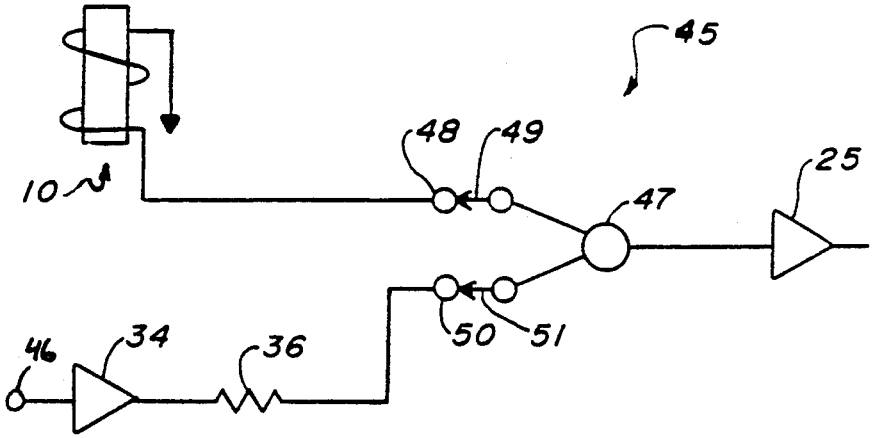
FIGS. 2A–2C are schematic views of a switch circuit used in connection with the sustain circuit of the present invention.

A typical, prior art sustain device is shown in FIG. 1 as including a magnetic pickup 10, a magnetic driver 12, and an amplifier 14 interposed in the circuit between the pickup 10 and the driver 12. The pickup is typically comprised of one or more pickup coils, such as pickup coil 11. The driver 12 is typically comprised of one or more driver coils, such as driver coil 13.

As will be appreciated, several different configurations of pickups and drivers exist. In this regard, the reader's attention is directed to Hoover and Osborne U.S. patent application Ser. No. 07/350,338 entitled STRING VIBRATION SUSTAINING DEVICE, which was filed on May 12, 1989. This '338 Patent Application is the parent application of the instant application, and includes a detailed description of various pickup and driver arrangements that have been used by others, and various pickup and driver arrangements invented by the Applicants that can be used in connection with the instant invention.

The sustain system may be used to sustain the vibration of a single string, such as string 16, or a plurality of strings. The sustain system is usually disposed on a counter-sunk portion of the upper surface of the body of the electric guitar.

The pickup and driver are constructed generally similarly. However, as prior art drivers are not used to produce an output in response to string vibration, the driver coil 13 typically includes a lower number of turns $N_D$ of conductor 18 around the magnetic core 22, than the number of turns $N_P$ of a conductor 20 around magnetic core 24 of the pickup coil 11. The fewer turns of wire $N_D$ in the driver coil 13 lowers the voltage required to drive the driver coil 13. Additionally, the fewer turns $N_D$ of wire in the driver coil 13 lowers the cost and complexity of the amplifier 14 that provides drive current to the driver 12. However, one drawback with the use of a lower number of turns $N_D$ of conductor 18 in the driver coil 13 is that the driver 12, when being used as a pickup, produces a lower output voltage in response to string vibration than the pickup 10. Thus, if one were to use a switch, for example, to alternately select between the use of the driver 12 in a driver mode of operation wherein it functions to produce sustain, and a pickup mode of operation, wherein the driver 12 functions as a second pickup, one would notice that the output of the pickup 10 and the driver 12 would not be matched during such times as the driver 12 was being used in the pickup mode of operation.

Several reasons exist why it is desirable to be able to use the driver 12 as a second pickup, during such times as the driver 12 is not being used to sustain string vibration. One reason is that the driver 12 is placed on the instrument in a location different than the location of the pickup 10. This difference in location between the driver 12 and the pickup 10 causes the driver 12 to be responsive to a different combination of string harmonics than the pickup 10. This different combination of string harmonics may be desired by the musician in order to achieve a certain desired sound.

A second reason that it is desirable to use the driver 12 as a second pickup relates to aesthetic enhancement of the guitar, and overcoming spatial constraints. For example, the Applicants attempted to place a driver on a HAMER CHAPPARAL guitar manufactured by HAMER GUITARS of 635 West University Drive, Arlington Heights, Ill. 60004. The HAMER CHAPPARAL guitar is built to normally include three pickups. Due to the three pickups already existing on the guitar, the space in which a driver could be placed was somewhat limited. By adding a driver to the guitar, virtually all of the space in which a pickup could be placed was used. By using a driver, however, which could operate in both a pickup mode and driver mode of operation, the Applicants were able to remove one of the pickups, and replace it with the "double duty" driver. Through this replacement of one of the pickups for a driver capable of doing a "double duty", the Applicants were able to maintain an appearance of the guitar similar to its appearance prior to the installation of the sustain device.

Another desirable advantage obtained through the use of a driver that can function as both a driver and a pickup is the reduction of the magnetic field that can impact on the string's vibration. As will be appreciated, the permanent magnet used in the driver can impact on the vibration of the string, even during such times as when the driver 12 is not being used to sustain the vibration of the string. This permanent magnetic field caused by the driver 12 tends to reduce the string's natural vibration. It will also be appreciated that this reduction in string vibration is also caused by all of the pickups 10 on the guitar. By using a driver which can perform as both a driver and a pickup, one less permanent magnetic field can impact the string, as compared to a situation wherein all existing pickups are kept and an additional driver capable only of performing as a driver is utilized.

Another desirable advantage obtained by the use of a driver that can perform as both a pickup and a driver is the cost savings achieved through the elimination of a conventional pickup from a guitar.

As discussed above, if a switch were inserted in a sustain circuit of FIG. 1 to permit the driver 13 to be used as a pickup means, the level of output of the driver 13 and the pickup 10 would be different, thus resulting in insufficient drive level to the external amplifier 25 and loudspeaker 27.

A circuit 32 of the present invention is shown in FIG. 2 to overcome these problems relating to mismatching.

Circuit 32 includes a pickup 10, a driver 12, and an amplifier 14, which are coupled to an external amplifier 25 and a loudspeaker 27. The above mentioned components are generally identical to those shown in the prior art sustain circuit of FIG. 1.

Additionally, the sustain circuit of FIG. 2 includes a second amplifier 34, an impedance means 36, a first switch 40, having a connector arm 41, and a second switch 42 having a connector arm 43.

The switches 40, 42 are movable between a "driver mode of operation" and a "pickup mode of operation". In the "driver" mode of operation, connector arm 41 of switch 40 is coupled to terminal 44 so that the output of amplifier 14 is fed to driver 12. Additionally, the connector arm 43 of switch 42 is connected to terminal 48, so that the output of pickup 10 is fed to amplifier 25.

In the "pickup" mode of operation, the connector arm 41 is coupled to terminal 46, so that the output from the driver 12 is fed to second amplifier 34 and impedance means 36. Impedance means 36 may not be required, as the second amplifier 34 in the circuit may be sufficient to provide the needed impedance. However, some sort of impedance is generally necessary when combining the outputs of the pickup 10 and the driver 12. If impedance is not added to the output of the amplifier 34, the low output impedance of second amplifier 34 would tend to shunt the output of pickup 10 when the outputs of the pickup 10 and driver 12 are added together. This shunting would likely result in only the output from driver 12 being fed to external amplifier 25. As will be appreciated, the impedance provided by impedance means 36 may be resistive, capacitive, or inductive (or some combination thereof), to provide a desired frequency response, when the outputs from the pickup 10 and the driver 12 are combined.

As shown in FIG. 2, when the driver 12 is operating in its pickup mode of operation, the connector arm 43 is connected to terminal 50, so that the output from amplifier 34, and hence driver 12, is fed to external amplifier 25. In such case, the output from pickup 10 is not fed to amplifier 25, as second switch 42 is in its "open" position with respect to terminal 48.

Figure 4:
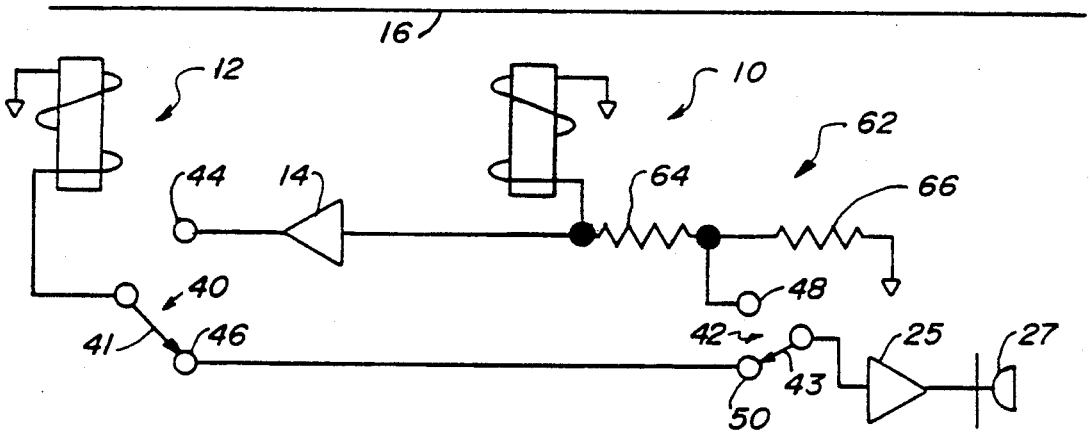
FIG. 4 is a schematic view of another embodiment of a sustain circuit of the first aspect of the present invention.

A three position second switch, such as switch 45, shown in FIGS. *2a*, *2b*, and *2c* may be used in lieu of two position switch 42 as shown in FIGS. 2, 3, and 4.

The three position switch 45 includes an adder means 47, and a pair of connector arm means 49, 51. Three position switch 45 is movable between a first position, shown in FIG. *2a*, a second position shown in FIG. *2b*, and a third position shown in FIG. *2c*. In the first position, connector arm 49, is coupled to terminal 48 at the output of pickup 10, and connector arm 51 is coupled to terminal 50, which is coupled through amplifier 34, impedance means 36, and switch 40 to the output of the driver 12. In the first position, the outputs from both the driver 12 and the pickup 10 are fed to the adder 47, and hence to external amplifier 25. Thus, the output from the switch 45 is the combined output of both the pickup 10 and the driver 12.

In the second position (shown in FIG. 2*b*), the connector arm 49 is coupled to the pickup output terminal 48. However, connector arm 51 is not coupled to the output terminal 50 of driver 12. Thus, the only output being fed to the adder 47, and hence external amplifier 25, is the output from pickup 10. This second position mode would be used during such times as the driver 12 is being used in its driver mode of operation. Additionally, this second position may be used during such time as no output is required from the driver 12, regardless of whether the driver 12 is performing its sustain function.

Figure 2B:
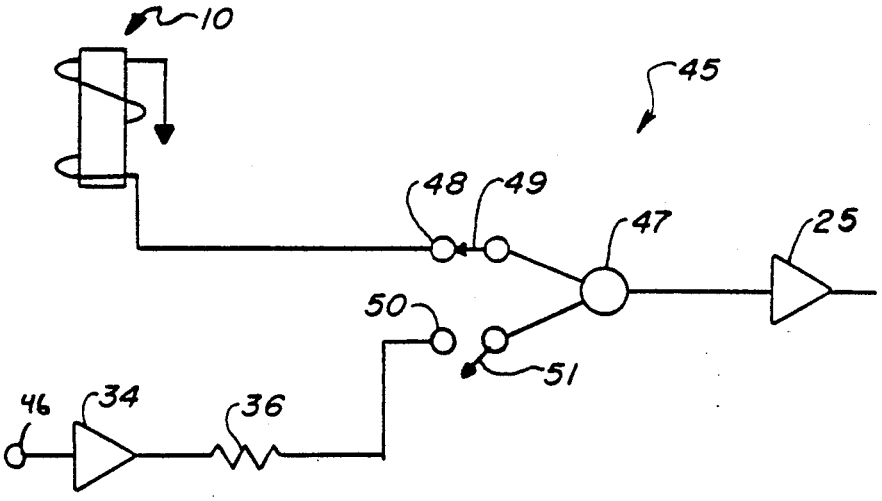
Figure 2C:
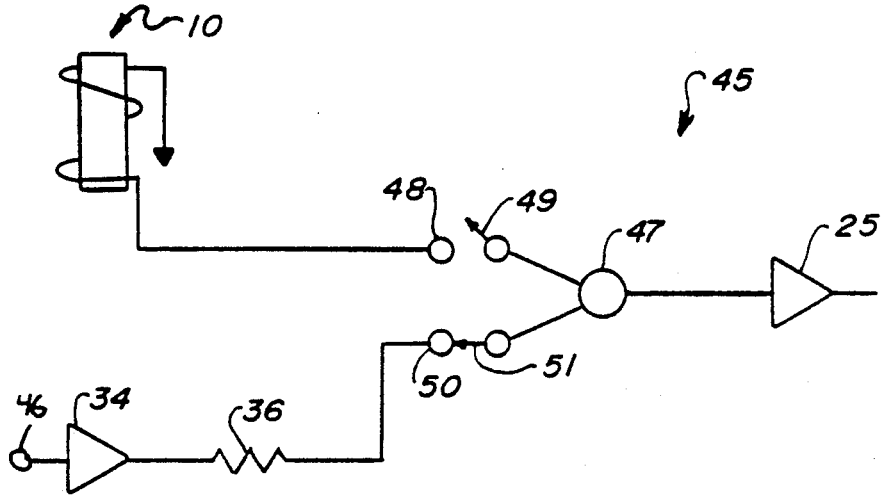

In the third position shown in FIG. 2*c*, the connector arm 49 of switch 45 is not coupled to the output terminal 48 of pickup 10. However, the connector arm 51 is coupled to the output terminal 50 of the driver 12. In this third position, the output of the driver 12, alone is being fed to adder 47, and hence external amplifier 25.

A matching means is shown in FIG. 3 that provides an alternate embodiment to the matching means shown in FIG. 2. Circuit 54 includes a pickup 10, driver 12, first amplifier 14, and a switch means, such as switches 40, 42, that are coupled to an external amplifier 25 and loudspeaker 27. In this regard, the embodiment of FIG. 3 is similar to that shown in FIG. 2. However, circuit 54 includes a transformer 56 and an impedance means 58 in place of the amplifier 34 and impedance means 36 shown in FIG. 2. The transformer 56 includes a first coil (primary winding) 59 and a second coil (secondary winding) 60, having a number of turns of a conductor, $N_{T1}$ and $N_{T2}$, respectively. The transformer 56 will amplify the driver output signal by a factor generally equal to the ratio of turns ($N_{T2}/N_{T1}$) of the respective secondary and primary winding 60, 59 respectively. One advantage of using a transformer 56 in lieu of a second amplifier (e.g. amplifier 34) is that a transformer 56 is passive, and therefore adds no amplifier noise to the driver output signal. Additionally, a transformer does not require a power supply, as does an amplifier.

The transformer further multiplies the dynamic impedance of the driver 12 by a factor equal to the transformer 56 turns ratio $N_{T2}N_{T1}$. Therefore, the transformer 56 has a higher output impedance than a corresponding amplifier 54. This higher output impedance may permit one to eliminate an additional impedance means, such as impedance means 58, to achieve the desired frequency response when the outputs from the driver 12 (functioning in its pickup mode of operation), and the pickup 10, are combined such as shown in FIG. 2*a*.

Another matching means for matching levels of the output of driver 12 and pickup 10 is shown in FIG. 4. In FIG. 4, an attenuator means 62 is employed. The attenuator 62 shown in FIG. 4, comprises a first resistor 64 and a second resistor 66. The first and second resistors, 64, 66 are provided to reduce the level of the output signal from pickup 10 to a level generally equal to the output of the driver 12.

The use of an attenuator 62 has an advantage similar to the use of a transformer 56, in that the attenuator 62 is passive, and does not add any amplifier noise to the output from the driver 12. Further, the values of the resistors 62, 66 can be adjusted to minimize the electrical loading on the pickup 10, and to provide an appropriate output impedance when the output signals of the pickup 10 and driver 12 are combined. If an attenuator 62 is used to reduce the output from the pickup 10, an external amplifier 25 having a relatively greater gain will be necessary to provide the same output level to speaker 27.

Although attenuator 62 is shown as being comprised of a pair of resistors, 64, 66, other devices such as capacitors or inductors, or some combination thereof, could be used to achieve a desired frequency response while matching the output level of the pickup 10 to the output of the driver 12.

Figure 5:
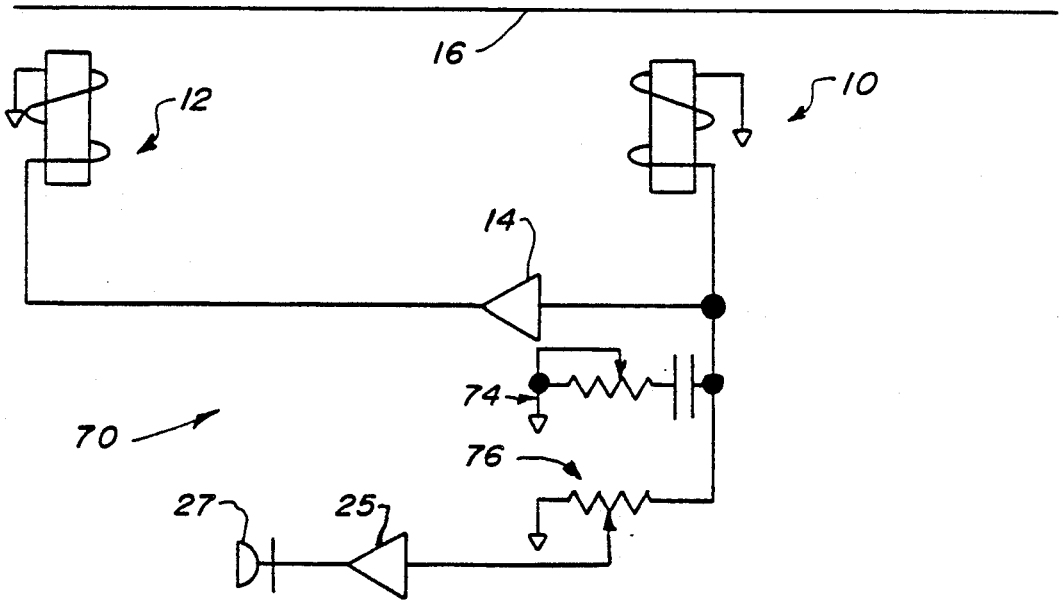
FIG. 5 (PRIOR ART)
FIG. 5 is a schematic view of another prior art sustain circuit.
Figure 6:
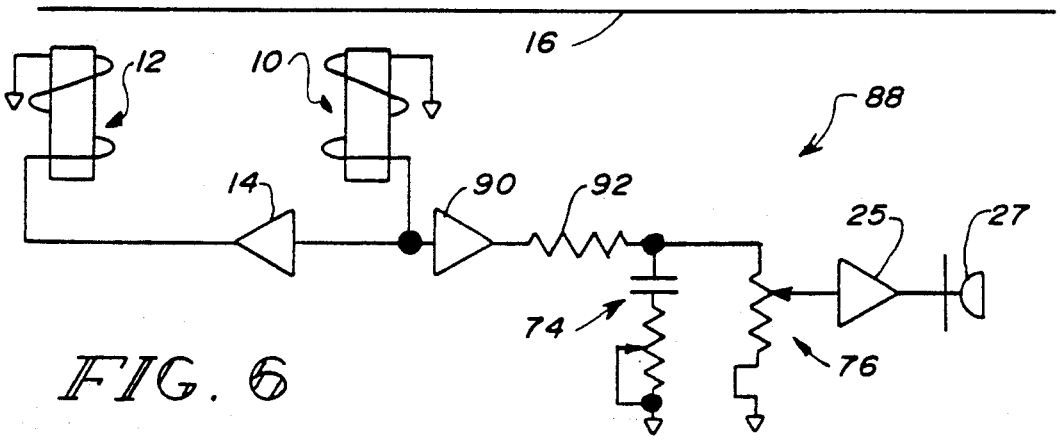
FIG. 6 is a schematic view of a sustain circuit embodying the second aspect of the present invention.
Figure 7:
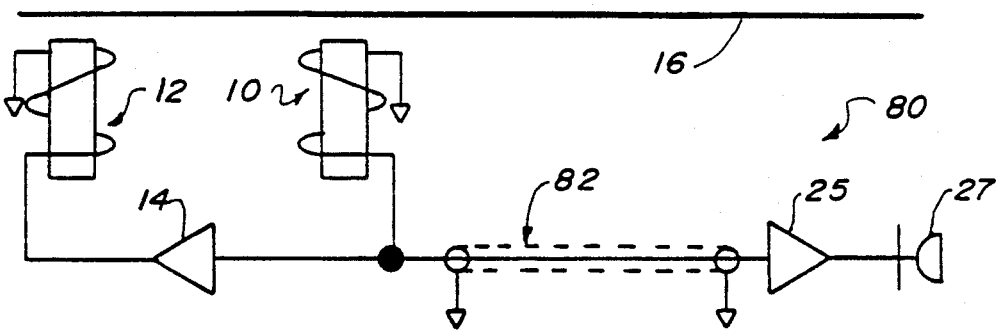
FIG. 7 (PRIOR ART)
FIG. 7 is another embodiment of a prior art sustain circuit.

Referring now to FIGS. 5–8, a second aspect of the present invention shall be described. FIG. 5 shows a prior art sustain circuit 70 having a pickup 10, and a driver 12, and a first amplifier 14. Circuit 70 is coupled to an external amplifier 25 and loudspeaker 27. The circuit 70 also includes a load generating means, here shown as a tone control 74 and a volume control 76. Referring now to FIG. 7, another prior art circuit 80 having a load generating device is shown. In circuit 80, the load generating device comprises a transmission cable 82 that extends between the output of the pickup 10 and the external amplifier 25.

A load generating devices such as tone control 74, volume control 76 and transmission cable 82 may affect the output signal of the pickup 10. In fact, the primary purpose of a tone control 74 and a volume control 76 is to affect the output signal that the pickup 10 transmits to the external amplifier 25. However, an undesirable side effect is that the tone control 74, volume control 76 or transmission cable 82 tend to change the output signal that the pickup 10 transmits through amplifier 14 to the driver 12. Due to this impact on the driver 12, the performance of the sustain device is dependent upon the tone control 74, volume control 76 or transmission cable 82.

Although it may be desirable to utilize the tone control 74 and volume control 76 to affect the output of the pickup 10 to the external amplifier 75, it is generally not desirable to allow the tone control 74 and volume control 76 to affect the output of the driver 12. Among the undesirable side effects caused by tone control 74, volume control 76, or transmission cable 82 is that a the tone control 74, volume control 76 or transmission cable 82 can result in too low of an amplitude of current being delivered to the driver 12, thus impairing the ability of the driver 12 to sustain the vibration of a string. Additionally, adjustments in the tone control 74 and the volume control 76 may change the phase of the signal delivered from the pickup 10 to the driver 12, also resulting in a loss of sustain.

To overcome these problems, the Applicants have invented the circuit 88 shown in FIG. 6. In circuit 88, a buffer amplifier 90 and impedance means 92 are interposed between the pickup 10 and the tone and volume controls, 74, 76. The buffer amplifier 90 provides a constant pickup output signal to the first amplifier 14. This constant signal provided by the buffer amplifier 90 allows the volume control 76 and tone control 74 to be adjusted without affecting the performance of the driver 12.

The output impedance means 92 is provided to stimulate the dynamic output impedance of the pickup 10 to maintain proper operation of the particular tone control circuit 74 shown in the drawing. Other types and varieties of tone control 74 and volume control 76 can be used. It will be appreciated that different tone controls and volume controls may not require the addition of an impedance means 92. Further, impedance means 92 may be resistive, capacitive, or inductive, or a combination thereof. It is also possible to integrate the tone and volume controls into the circuitry of amplifier 90.

Figure 8:
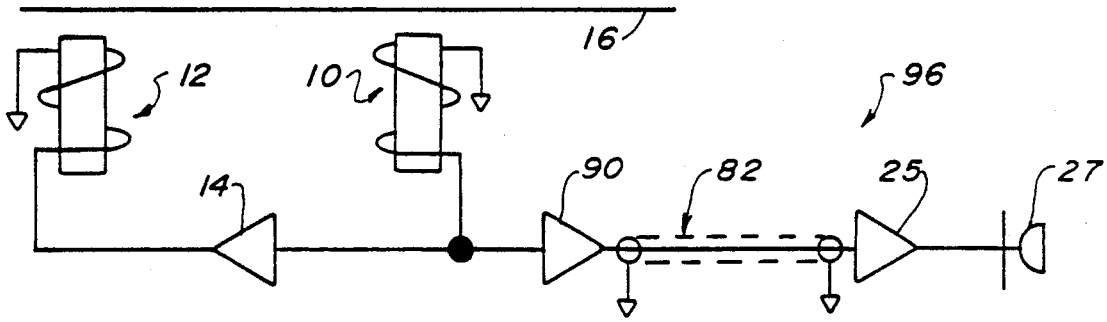
FIG. 8 is a schematic view of another embodiment of a sustain circuit of the second aspect of the present invention.

Circuit 96 shown in FIG. 8 represents an application of the Applicants' invention to a circuit wherein the load generating device comprises a transmission cable 82. The capacitive loading of the cable 82 tends to degrade the high frequency response of the pickup 10, and therefore disrupts the performance of the sustain device. In circuit 96, the buffer amplifier 90 isolates the pickup 10 from the capacitive loading affects of the transmission cable 82.

Although the buffer amplifier 90 is shown as isolating the pickup 10 from load generating devices such as a tone control 74, a volume control 76, and a transmission cable 82, the buffer amplifier of the instant invention could be used to isolate the pickup 10 from any electrical load.

Another aspect of the present invention is disclosed with relation to FIGS. 9–16.

Figure 9:
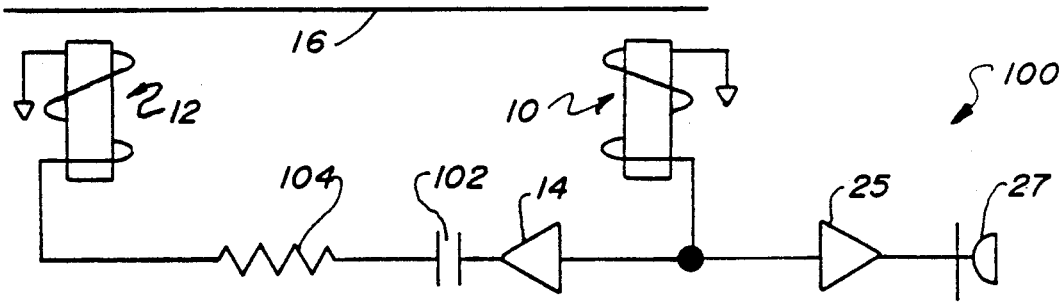
FIG. 9 (PRIOR ART)
FIG. 9 is another embodiment of a prior art sustain circuit.

A prior art sustain circuit is shown in FIG. 9 as including a pickup 10, a driver 12, first amplifier 14, a blocking capacitor 102, and an impedance means 104. The blocking capacitor 102 is a DC blocking capacitor that is placed in series with the output of the first amplifier 14. The use of DC blocking capacitors such as capacitor 102 in amplifiers is well known. Typically, the blocking capacitor 102 has a capacitance which is chosen to be great enough to pass all frequencies of interest through the capacitor 102, while blocking any DC offset voltages that may be present at the output of the first amplifier 14.

One difficulty with sustain circuits such as circuit 100, is that the driver 12 tends to be inefficient. More particularly, the driver 12 tends to be inefficient at relatively higher frequencies due to its inductive reactance. This inefficiency results in greater voltage drive requirements to provide sufficient power to the driver to sustain a vibration of a string.

As alluded to above, the efficiency of the driver tends to decrease at increasing frequencies. Thus, the driver is less efficient at relatively higher frequencies. This inefficiency at higher frequencies tends to limit the effective band width at which the driver can sustain string vibration. Therefore, such a prior art sustain circuit is rather inefficient at sustaining high frequency string vibrations. This inefficiency is especially troublesome in battery operated sustain devices as the power consumption required by an inefficient driver tends to limit the effective length of life of a battery powering such a battery powered sustain device.

Figure 10:
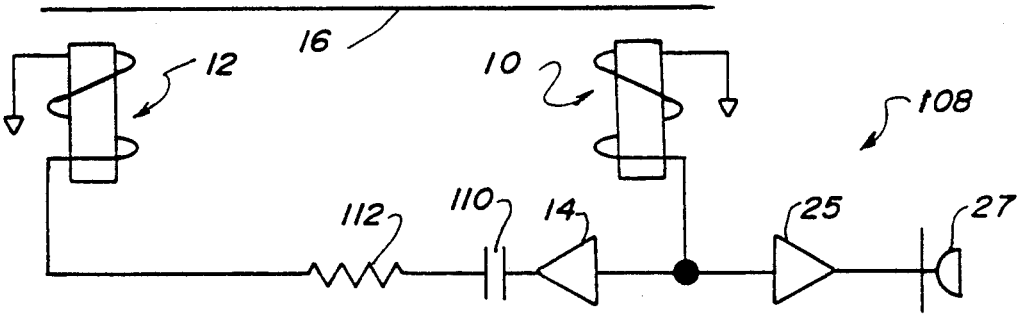
FIG. 10 is a schematic view of a sustain circuit embodying the third aspect of the present invention.

FIG. 10 shows the Applicants' invention for overcoming the problems discussed above. Circuit 108 of FIG. 10 includes pickup 10, a driver 12, and a first amplifier 14. A capacitor 110 and resistor 112 are chosen to create, with driver 12, a resonance circuit. That is, the capacitor and resistor have been selected to provide electrical resonance with the inductive reactance $L_{DR}$ of the driver 12.

In order to select the capacitor, one employs the following equation:

$$C_{RES} = \frac{1}{4\pi^2 F_o^2 L_{DR}}$$

wherein $F_o$ is the resonant frequency expressed in hertz; $L_{DR}$ is the inductive reactance of the driver expressed in henries; and $C_{RES}$ is the capacitance of the capacitor 110, expressed in farads. Through a proper selection of a capacitor, resonance can be obtained. Optimally, the capacitance $C_{RES}$ of the capacitor 110 is chosen so that the resonant frequency $F_o$ is between about the first and seventh harmonic frequencies of the string.

A resistor 112 may be optionally added to the circuit. Alternately, the resistance caused by the coils of the driver 12, may be used to select the band width of the resonance circuit according to the following equation:

$$BW = \frac{R}{2\pi L_{DR}}$$

wherein BW = the band width, R = the resistance of resistor 112, expressed in ohms; and $L_{DR}$ is the inductive reactance of the driver 12 expressed in henrys.

Thus, the capacitor 110, resistor 112, and driver 12 form a resonance circuit. By selecting the components of the resonance circuit (the driver 12, the capacitor 110, and the resistor 112) so that the resonant frequency $F_o$ and the band width BW coincide with a desired range of string harmonic frequencies, the driver efficiency is increased and the sustain device will be able to sustain the harmonics of the string 16 while drawing a lesser amount of energy from the power supply. This increase in efficiency is especially important in achieving satisfactory sustain of harmonics with a power supply with limited energy, such as a battery powered sustain device. Even in non-battery powered applications, this increase in efficiency is especially helpful in enabling the driver to more efficiently sustain high frequency string harmonics.

Although the circuit 108 of FIG. 10 shows a series resonance circuit for increasing the efficiency of driver 12, other resonance circuits may be applied to achieve similar results. As will be appreciated, the resonance circuit must contain at least one capacitor, however, to resonate with the inductive reactance of the driver 12.

Figure 11:
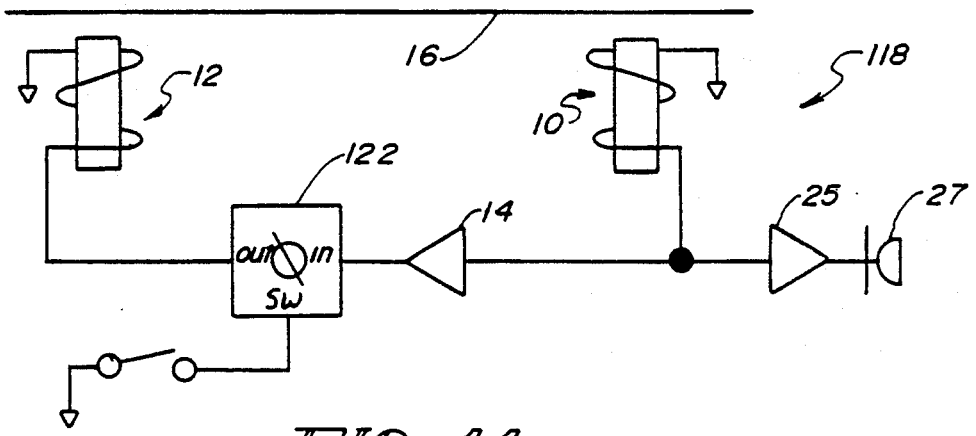
FIG. 11 (PRIOR ART)
FIG. 11 is a schematic view of another embodiment of a prior art sustain circuit.

Another prior art sustain circuit 118 is shown in FIG. 11. Circuit 118 includes a pickup 10, a driver 12, and a first amplifier 14. Additionally, circuit 118 includes a phase manipulation device 122. The purpose of the phase manipulation device 122 is to provide selective sustain of string harmonics.

Several phase manipulation circuits exist that may be used as phase manipulation circuit 122. Some illustrative phase manipulation circuits are circuit 144, shown in FIG. 13; circuit 146, shown in FIG. 14; circuit 148, shown in FIG. 15; and circuit 150, shown in FIG. 16. Additional examples of phase circuits are disclosed in Hoover and Osborne U.S. patent application No. 06/937,871 that was filed on Dec. 4, 1986.

Figure 12:
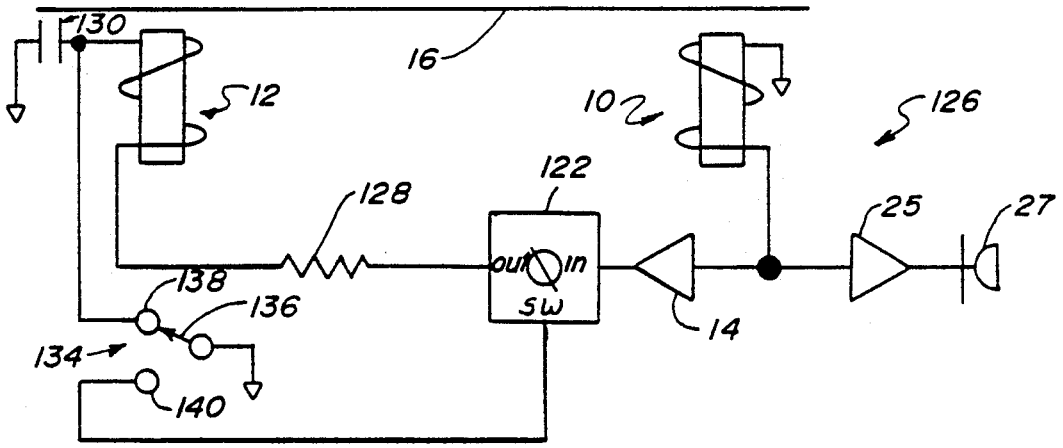
FIG. 12 is a schematic view of another embodiment of a sustain circuit of the third aspect of the present invention.
Figure 13:
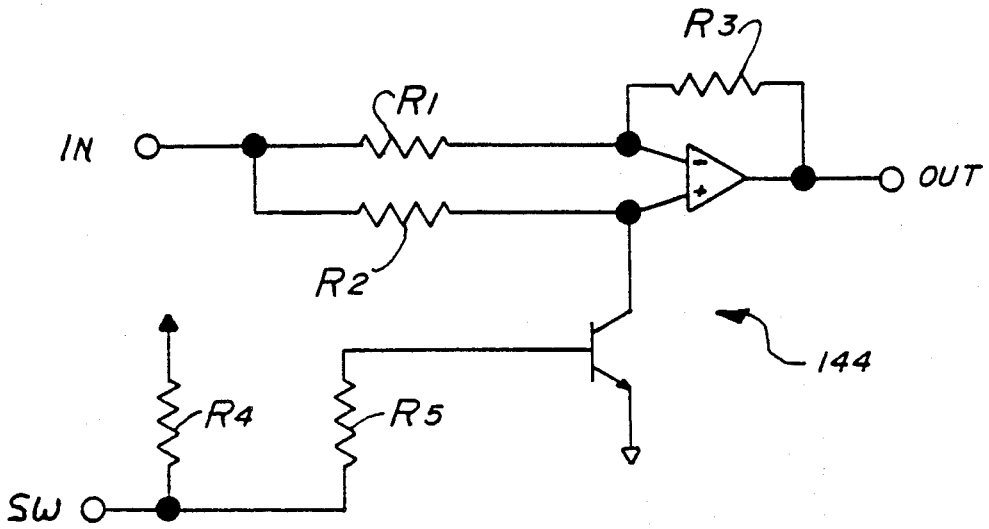
FIGS. 13–16 are schematic views of phase manipulation circuits that can be used in conjunction with the sustain device of the present invention.
Figure 14:
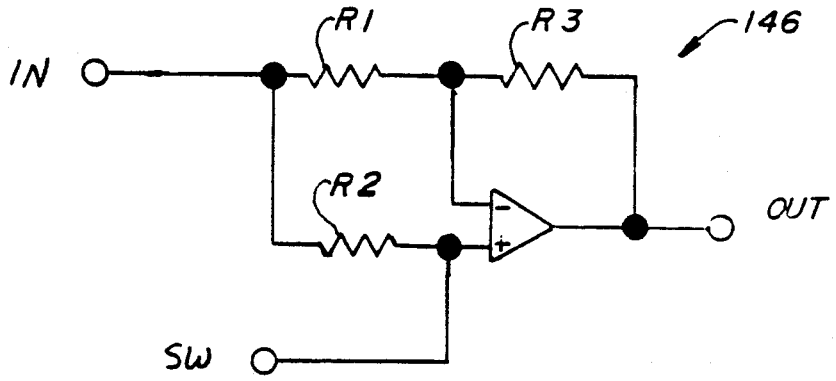
Figure 15:
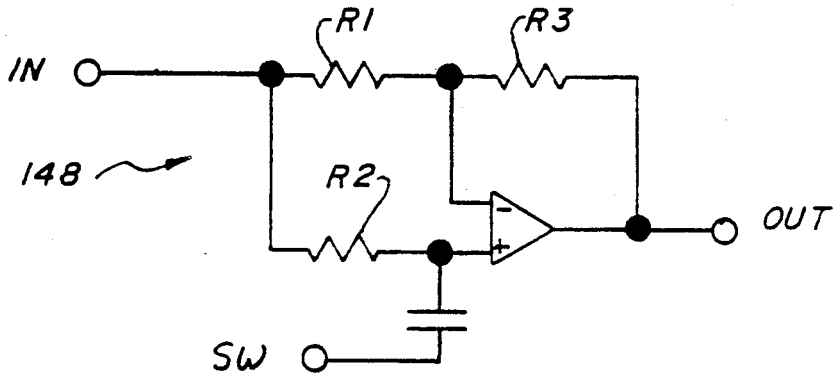
Figure 16:
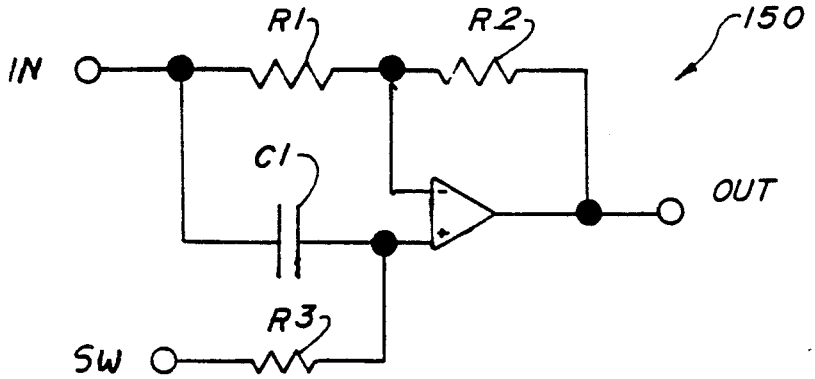

Another embodiment of a resonant circuit of the present invention is shown in FIG. 12. Circuit 126 includes a pickup 10, a driver 12, and a phase manipulation circuit 122. Additionally, the circuit includes a resistor 128 and a capacitor 130. Capacitor 130 and resistor 128 are selected to form, with driver 12, a resonance circuit. Capacitor 130 has been selected to provide electrical resonance with the inductive reactance $L_{DR}$ of the driver 12.

Switch 134 includes a connector arm 136 movable between terminal 138 and terminal 140. When switch 134 is positioned so that connector arm 136 engages terminal 138, the capacitor 130 is shorted to ground and the driver resonance created by the resonance circuit is defeated. Simultaneously, switch 134 causes the phase manipulation circuit 122 to provide zero phase shift. This results in the driver 12 sustaining the strings' 16 fundamental frequency.

When the switch 134 is positioned so that connector arm 136 engages terminal 140, the resonance of driver 12 is activated and the phase manipulation circuit 122 shifts the phase induced by driver 12, to produce a sustain of string harmonics.

Although the switch 134 shown in FIG. 12 alternately activates and defeats the driver resonance circuit, while simultaneously controlling the phase circuit with the single pole switch, switches with multiple poles and multiple positions may be applied with elaborate resonance and phase circuits to achieve a desire variability of performance of the sustainer device 8.

Another aspect of the present invention will now be described with regard to FIGS. 17 and 18.

Figure 17:
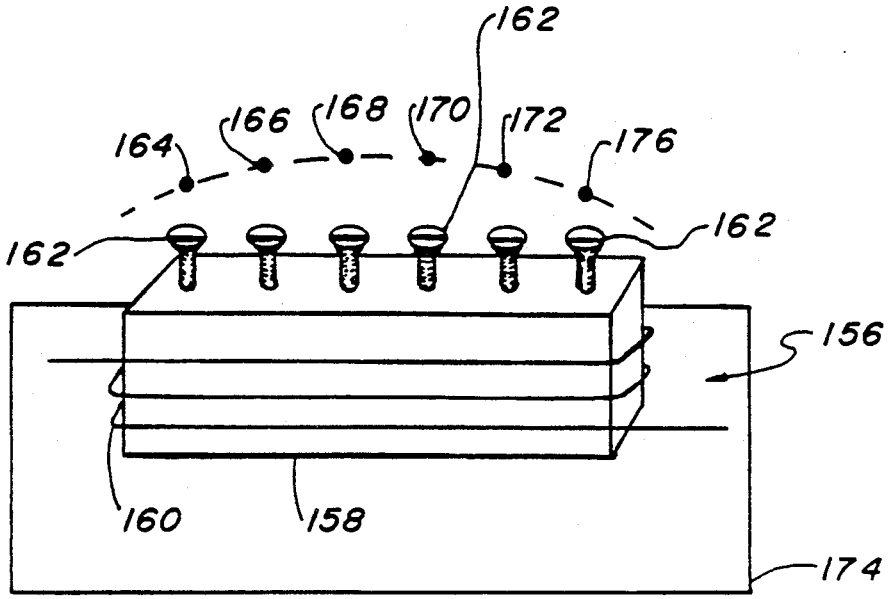
FIG. 17 (PRIOR ART)
FIG. 17 is a schematic sectional view of a prior art driver means used in conjunction with a sustain circuit.

FIG. 17 is a sectional view of a guitar body 174 into which a driver means 156 is placed. The driver comprises a permanent magnetic core 158 having a conductor coil 160 wrapped therearound in a generally lengthwise direction. A series of magnetic pole pieces 162 are adjustably positionable in the magnetic core 158. It will be noticed that an individual pole piece 162 exists for each of the six strings 164, 166, 168, 170, 172, and 176 of the guitar. The individual pole pieces 162 are adjustably positionable in a generally vertical plane so that the individual pole pieces 162 can be moved closer to, or farther away from, their respective string. By adjusting the relative distance between the pole piece 162 and the respective string 164, 166, 168, 170, 172, and 176, the users can adjust the drive energy applied to each individual string 164, 166, 168, 170, 172, and 176.

One difficulty encountered with the use of individual pole pieces 162, such as those shown with driver 156, is that the ability of the driver 156 to sustain the vibration of a string is adversely affected by misalignment of the string or the bending of the string that typically occurs when the string is plucked during playing. In either case, the string moves away from the pole piece 162, to thereby reduce the vibration induced in the string by the driver means.

Figure 18:
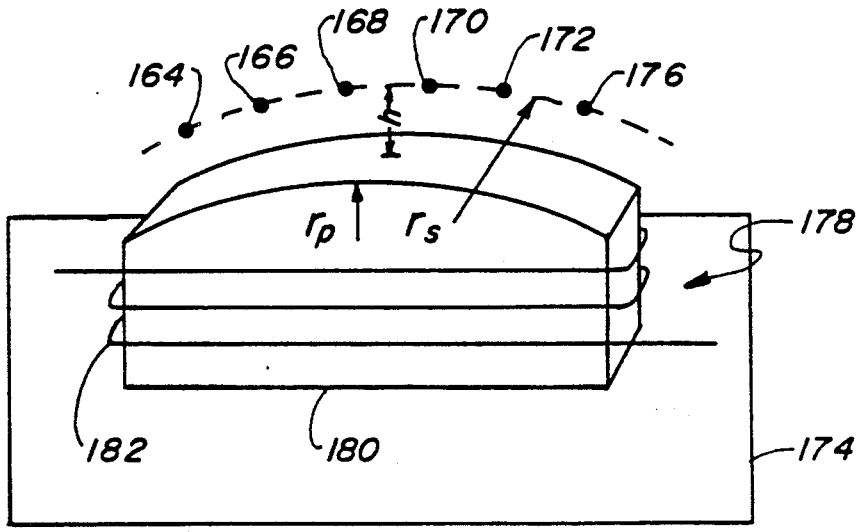
FIG. 18 is a schematic sectional view of a driver coil used in conjunction with a sustain circuit of the present invention.

In order to overcome the difficulties discussed above due to misalignment and bending of the strings, the Applicants' driver means shown in FIG. 18 has been invented. Driver means 178 includes curved magnetic pole piece 180, having a coil of wire 182 wrapped therearound. The general dimensions of each of the pole pieces are approximately 58 mm. long, 1.5 mm. thick, and approximately 20 mm. high. The pole piece 180 radius of curvature $r_P$ is approximately equal to 1200 mm. The pole piece radius of curvature $r_P$ is selected to be less than the string radius $r_S$, and to provide a constant distance h, between the pole piece 162 and the strings. The constant distance between the pole piece 180 and the strings is given by the equation $h=r_S-r_P$. The major plane of each of the pole pieces is oriented generally perpendicular to the plane of the strings 164, 166, 170, 172, 176.

It was found by the Applicants that this dual coil driver, with each coil having a single pole piece, did not suffer from a loss of sustain when the strings were either bent or misaligned.

Another embodiment of the present invention is discussed below with reference to FIGS. 19 and 20. The embodiment shown in FIGS. 19 and 20 discloses a means for unbalancing either the pickup, driver, or both, so that a magnetic imbalance is created between the pickup and the driver to minimize direct magnetic feedback between the pickup and the driver. By so minimizing the direct magnetic feedback between the pickup and the driver, the effects of direct magnetic feedback can be reduced substantially. A more complete discussion of the effects of unbalancing a pickup and a driver, and various other methods for creating this unbalanced situation, is contained in the Applicants, parent Application, Ser. No. 07/350,338, filed May 12, 1989.

As discussed in this parent Application, a shunt plate can be placed between the pickup and driver in order to create this magnetic imbalance.

Sustain device 198 is partially shown in FIGS. 19 and 20, as including a pickup 202 and a driver 208. Pickup 202 includes a permanent magnetic core 204 having a winding of conductor wire 206, wrapped lengthwise therearound. Pickup 202 also includes a pole piece 207 disposed directly beneath a string 200 of the stringed musical instrument. Driver 208 includes a permanent magnetic core 210 having a winding of conductor wire 212 wrapped lengthwise therearound and a pole piece 214 placed adjacent to the side of the driver 208. Preferably, the shunt plate 216 is disposed under string 200. A generally planar shunt plate 216 is coupled to the side of the driver 208, and is provided for unbalancing the driver 208.

As best shown in FIGS. 19 and 20, the shunt plate 216 is comprised of a magnetically permeable material, such as cold-rolled steel, and is positioned adjacent to or on the driver 208, in a position wherein the shunt plate 216 is placed between the driver 208 and the pickup 202. The shunt plate 216 has a major plane disposed generally perpendicular to a plane 220 (indicated by a dashed line in FIG. 20) in which the strings 200 are disposed.

The shunt plate preferably has a length L of approximately 58 mm., a width W of approximately 20 mm., and is approximately 1.5 mm. thick.

The shunt plate 216 should not be so large so that the shunt plate 216 intersects the plane 220 of the strings 200.

Although the various aspects have been shown as being used singly, it will be appreciated that the various aspects could be combined into a single sustain device. Therefore, a single sustain device could have a switch and a matching means (such as shown in FIGS. 2, 3, or 4); a buffer amplifier (such as is shown in FIGS. 6 and 8); a phase manipulation circuit and resonance circuit (such as shown in FIGS. 10 and 12); a curved magnetic pole piece driver (such as is shown in FIG. 18)and an unbalancing means (such as is shown in FIGS. 19 and 20).

Although the invention has been described in detail with reference to the illustrated preferred embodiments, variations and modifications exist within the scope and spirit of the invention as described and as defined in the following claims.

What is claimed is:

1. A sustaining device for prolonging the vibration of a string of a stringed musical instrument having a first magnetic pickup means responsive to the vibration of the string, the sustaining device comprising:

a magnetic string driver means capable of inducing a vibration in the string;

a first amplifier means for amplifying the output of the pickup means to a level that provides sufficient energy to the driver means to prolong the vibration of the string, a switch means coupled to the driver means for selecting the mode of operation of the driver means between a pickup mode of operation wherein the driver functions as a second magnetic pickup means, and a driver mode of operation wherein the driver means functions as a magnetic string driver means, output changing means responsive to the switch means for changing the output of at least one of the first pickup means and driver means in response to a change in the mode of operation of the driver means.

2. The sustaining device of claim 1 wherein the output changing means comprises a matching means for matching the output of the driver means to the output of the first pickup means when the driver means is in the pickup mode of operation.

3. The sustaining device of claim 1 wherein the output changing means comprises a second amplifier means coupled to the driver means, through the switch means, when the driver means is in the pickup mode of operation.

4. The sustaining device of claim 1 wherein said second amplifier means includes an output impedance means for providing the second amplifier means with an output impedance generally equal to the impedance of the first pickup means.

5. The sustaining device of claim 4 wherein the output impedance means comprises a resistive impedance means.

6. The sustaining device of claim 4 wherein the output impedance means comprises a capacitive output impedance means.

7. The sustaining device of claim 4 wherein the output impedance means comprises an inductive impedance means.

8. The sustaining device of claim 1 wherein the output changing means comprises a transformer means coupled to the driver means, through the switch means, when the driver means is in the pickup mode of operation.

9. The sustaining device of claim 8 wherein the transformer means includes an output impedance means for providing the transformer means with an output impedance generally equal to the impedance of the first pickup means.

10. The sustaining device of claim 1 wherein the output changing means comprises an attenuator means coupled to the first pickup means.

11. The sustaining device of claim 10 wherein the attenuator means includes an output impedance means for providing the attenuator means with an output impedance generally equal to the impedance of the driver means.

12. A sustaining device for prolonging the vibration of a string of a stringed instrument having a first magnetic pickup means responsive to the vibration of the string, the sustaining device comprising (1) a magnetic string driver means for inducing a vibration in the string, the magnetic string driver means having an inductive reactance, (2) a resistance means coupled to the driver means, (3) a first amplifier means for amplifying the output of the pickup means to a level that provides sufficient energy to the driver means to prolong the vibration of the string, and (4) a capacitor means coupled to the driver means, the capacitor means having a capacitance selected to provide a capacitive reactance for resonating with the inductive reactance of the driver means at a resonant frequency generally equal to a harmonic frequency of the string, wherein the driver means, the resistance means and the capacitor means comprise a resonant circuit for increasing efficiency of the driver means.

13. The sustaining device of claim 12 wherein the capacitor means, resistor means, and driver means, when coupled in a resonant circuit, have a resonant frequency of between about a second and seventh multiple of a fundamental frequency of the string.

14. The sustaining device of claim 12 wherein the capacitance ($C_{RES}$) of the capacitor is chosen so that $C_{RES}$ approximates $$\frac{1}{4\pi F_o^2 L_{DR}},$$

wherein $F_o$ = resonant frequency desired $C_{RES}$ = the capacitance of the capacitor $L_{DR}$ = the inductance of the driver means.

15. The sustaining device of claim 12, further comprising a phase manipulation means for selectively sustaining string harmonics.

16. The sustaining device of claim 15 further comprising a switch means operatively coupled to the resonant circuit and the phase manipulation means for controlling simultaneously the phase manipulation means and the driver means.

* * * * *